US007836836B2

(12) United States Patent
Brewer

(10) Patent No.: US 7,836,836 B2
(45) Date of Patent: Nov. 23, 2010

(54) SELF-ADJUSTING CAM FOLLOWER BRACKET FOR TUFTING MACHINE

(76) Inventor: Stephanie Brewer, 235 Magnolia Ct., Summerville, GA (US) 30747

( * ) Notice: Subject to any disclaimer, the term of this patent is extended or adjusted under 35 U.S.C. 154(b) by 716 days.

(21) Appl. No.: 11/762,446

(22) Filed: Jun. 13, 2007

(65) Prior Publication Data

US 2008/0236464 A1 Oct. 2, 2008

Related U.S. Application Data

(60) Provisional application No. 60/908,830, filed on Mar. 29, 2007.

(51) Int. Cl.
*D05C 15/04* (2006.01)
*D05B 69/30* (2006.01)

(52) U.S. Cl. ..... 112/80.01; 112/220

(58) Field of Classification Search ..... 112/80.01, 112/80.4–80.45, 220; 384/190.5, 215, 223, 384/219, 247, 252, 256, 260
See application file for complete search history.

(56) References Cited

U.S. PATENT DOCUMENTS 957,921 A * 5/1910 Whitehead ..... 19/122
1,004,771 A * 10/1911 Gibbons ..... 72/237
1,023,355 A * 4/1912 Bancroft ..... 100/162 R
1,185,745 A * 6/1916 Weismiller ..... 384/256
3,684,332 A * 8/1972 Benson et al. ..... 384/256
4,018,171 A * 4/1977 Stone et al. ..... 112/80.72
4,285,287 A 8/1981 Inman
4,366,761 A 1/1983 Card
4,399,758 A 8/1983 Bagnall
4,465,001 A 8/1984 Ingram
4,669,403 A 6/1987 Bagnall
4,676,670 A * 6/1987 Nisley ..... 384/247
4,759,199 A 7/1988 Prichard
5,193,472 A 3/1993 Crossley
5,526,760 A 6/1996 Ok
5,794,551 A 8/1998 Morrison et al.
5,979,344 A 11/1999 Christman, Jr.
6,009,818 A * 1/2000 Card et al. ..... 112/80.73

* cited by examiner

*Primary Examiner*—Ismael Izaguirre
(74) *Attorney, Agent, or Firm*—Gardner Groff Greenwald & Villanueva, P.C.

(57) ABSTRACT

The present invention provides a cam follower bracket that is used in conjunction with textile tufting machines. Typically, the present invention is used with shifting tufting machines used to produce carpet and rugs. The cam follower bracket utilizes a floating lug design that self-regulates the amount of pressure that the cam follower bearings apply against the shifter block of the tufting machine. Because the bracket is able to self-regulate the pressure, the bracket generally lasts longer and does not need to be periodically monitored and/or tightened. Therefore, less user interaction is required and less machine downtime is needed when operating a tufting machine utilizing a bracket according to the present invention in comparison with known cam follower brackets.

16 Claims, 7 Drawing Sheets

SELF-ADJUSTING CAM FOLLOWER BRACKET FOR TUFTING MACHINE

CROSS-REFERENCE TO RELATED APPLICATION

This application claims the benefit of U.S. Provisional Patent Application Ser. No. 60/908,830, filed Mar. 29, 2007, which is hereby incorporated herein by reference in its entirety for all purposes.

TECHNICAL FIELD

The present invention relates generally to the field of carpet tufting machines, and more particularly to cam follower brackets for carpet tufting machines.

BACKGROUND OF THE INVENTION

The use of tufting machines to create tufted materials, such as carpet and rugs, is well known in the art. The art of tufting incorporates a plurality of yarn carrying needles extending transversely across the machine. Conventional tufting machines use a reciprocating needle bar, which carries the plurality of needles. The needles are constructed and arranged to reciprocate cyclically beneath the needle bar to penetrate and insert pile into a backing material passing below the same in a longitudinal direction. During each penetration of the backing material a row of pile is produced transversely across the backing. Successive penetrations result in a longitudinal row of pile produced by each needle.

The amount of tufted goods that can be produced by any given machine is often limited by the speed of the tufting machine. Therefore, the speeds of tufting machines have increased substantially throughout the development of the tufting art. As the speeds of tufting machines have increased to over 2000 rpm, it has been discovered that many of the moving parts tend to wear increasingly fast, and additionally, it has been found that the needle bar can crack and break due to the excessive vibration caused by such high speeds. Unfortunately, needle bars are very expensive to replace in terms of both money and machine downtime. Furthermore, it has been found that vibration damage is even more likely to occur when a shifting needle bar arrangement is used to create patterns in the tufted goods.

To combat vibration damage that occurs at high speeds, cam follower brackets 10, as seen in FIGS. 1-3, have been used in the art to dampen the vibrations at the needle bar due to the tufting machines' high-speed vertical reciprocating motion. Known cam follower brackets are typically mounted to the tufting machine's Thompson rods/bars 20 and are traditionally equipped with two cam follower bearings 30. The bearings 30 are forced against both sides of an elongated shifter block 40, which is coupled to the top of the needle bar 50. As the needle bar 50 and shifter block 40 vertically reciprocate, pressure applied by the bearings 30 onto the shifter block 40 helps prevent the needle bar from vibrating. Over time however, the cam follower bearings 30 and shifter block 40 begin to wear. Therefore, a user must periodically tighten the bearings 30 against the shifter block 40 to maintain an adequate pressure against the same.

Presently, there are two known types of cam follower brackets that are used in the art. The first type is that shown in FIG. 2, which utilizes bearings 30 having an eccentric shaft 35. The shaft 35 can be turned within a substantially cylindrical bore 15 of the bracket 10', such that more or less pressure is applied against the shifter block 40. A user can then bolt the bearing 30 in place when the desired level of pressure against the block 40 has been achieved. The second type of cam follower bracket 10, as seen in FIG. 3, has an elongated cylindrical bore 15, within which the bearing shaft 35 horizontally slides. To tighten the bearing 30 against the shifter block 40 a setscrew 38 is utilized to force the bearing against the same.

Unfortunately, when a user utilizes either of the arrangements as discussed above, the user must continuously monitor the bearings' 30 configuration to make sure that the appropriate amount of force is being applied to the shifter block 40. Too much pressure can cause the needle bar 50 to crack and break, while too little pressure can cause excessive needle bar vibration. Additionally, neither of the aforementioned cam follower brackets 10 and 10' are well suited for uneven bearing 30 and shifter block 40 wear, which is a very typical problem. For example, once a bearing 30 or shifter block 40 begins to wear unevenly, the needed amount of bearing pressure against the block can vary widely over the course of one reciprocating cycle. Presently, known brackets only permit one constant pressure, which can cause further uneven wear and damaging vibrations.

Thus it can be seen that needs exist for improvements to cam follower brackets to minimize the amount of user monitoring and permit a variable range of bearing pressure against the shifter block. It is to the provision of these needs and others that the present invention is primarily directed.

SUMMARY OF THE INVENTION

The present invention provides for a cam follower bracket that is used in conjunction with textile tufting machines. Typically, the present invention is employed in shifting tufting machines used to produce carpet and rugs. The cam follower bracket utilizes a floating lug design that self-regulates the amount of pressure that the cam follower bearings apply against the shifter block of the tufting machine. Because the bracket is able to self-regulate the pressure, the bracket lasts longer and does not need to be periodically monitored and/or tightened. Therefore, less user interaction is required and less machine downtime is needed when operating a tufting machine utilizing a bracket according to the present invention in comparison with known cam follower brackets.

In one aspect, the present invention is an improvement to a cam follower bracket for use in a tufting machine. The bracket being improved upon is typically mounted to the machine's Thompson bars/rods and has a rigid bracket body for receiving at least two cam follower bearings that guide and stabilize a shifter block of the machine. The improvement includes a floating lug, bracket cap, and compression spring. The floating lug is received by a cutout in the bracket that transversely accepts one cam follower bearing therein. The bracket cap secures the floating lug within the cutout in the bracket. The compression spring is secured between the floating lug and bracket cap for biasing the lug, whereby the cam follower bearing received by the floating lug applies a substantially horizontal force against the shifter block.

In another aspect, the invention is a cam follower bracket that comprises a bracket body and a floating lug. The bracket body receives a first cam follower bearing and the floating lug receives a second cam follower bearing. The floating lug is spring biased. Optionally, the floating lug has a lip that is received by a corresponding channel in a cutout of the bracket body. The spring used to bias the floating lug can have a load rating of between about 85-90 lbs.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
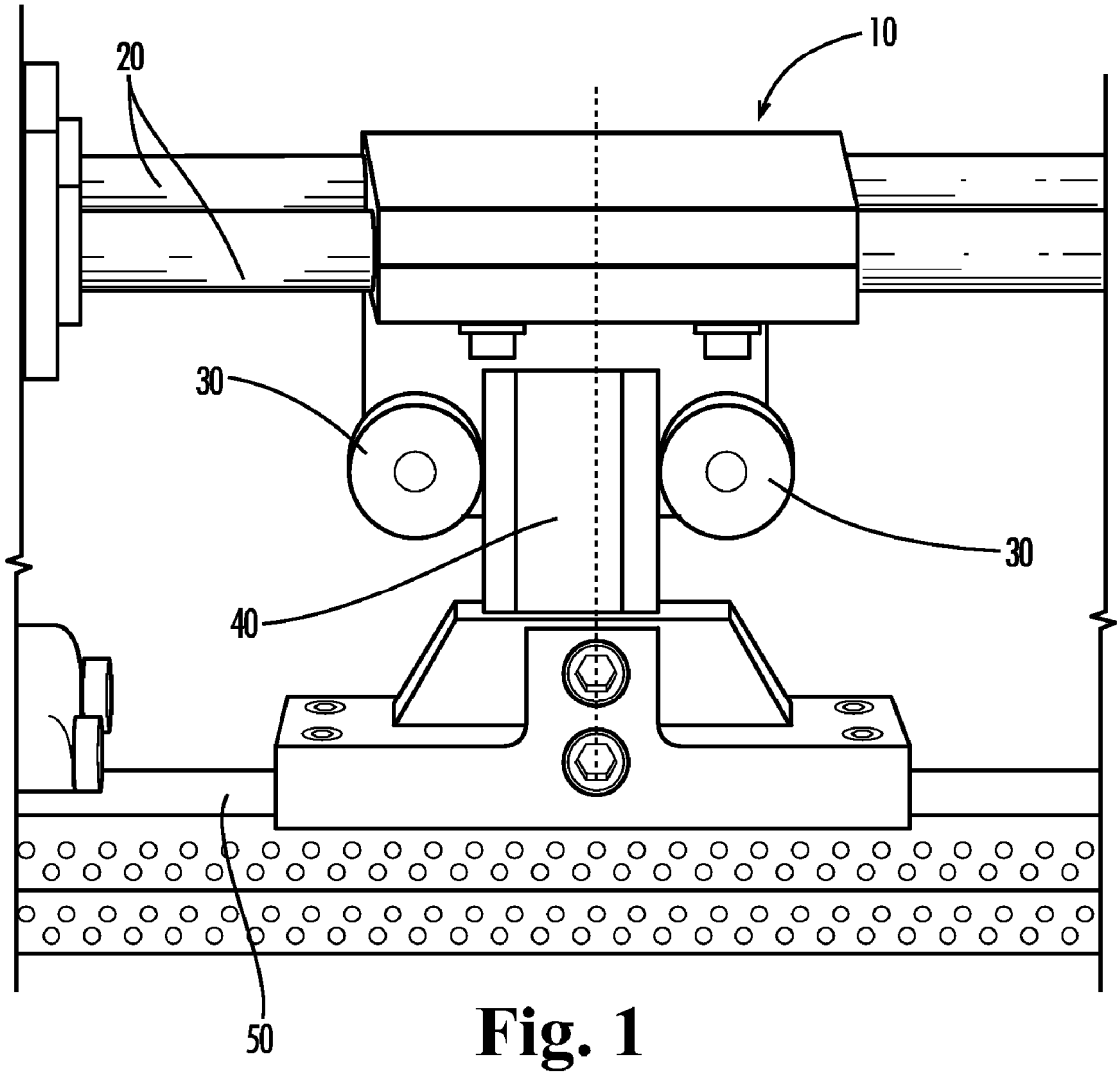
Fig. 1 (Prior Art)
FIG. 1 is a rear view of a prior art cam follower bracket shown mounted onto a tufting machine.
Figure 2:
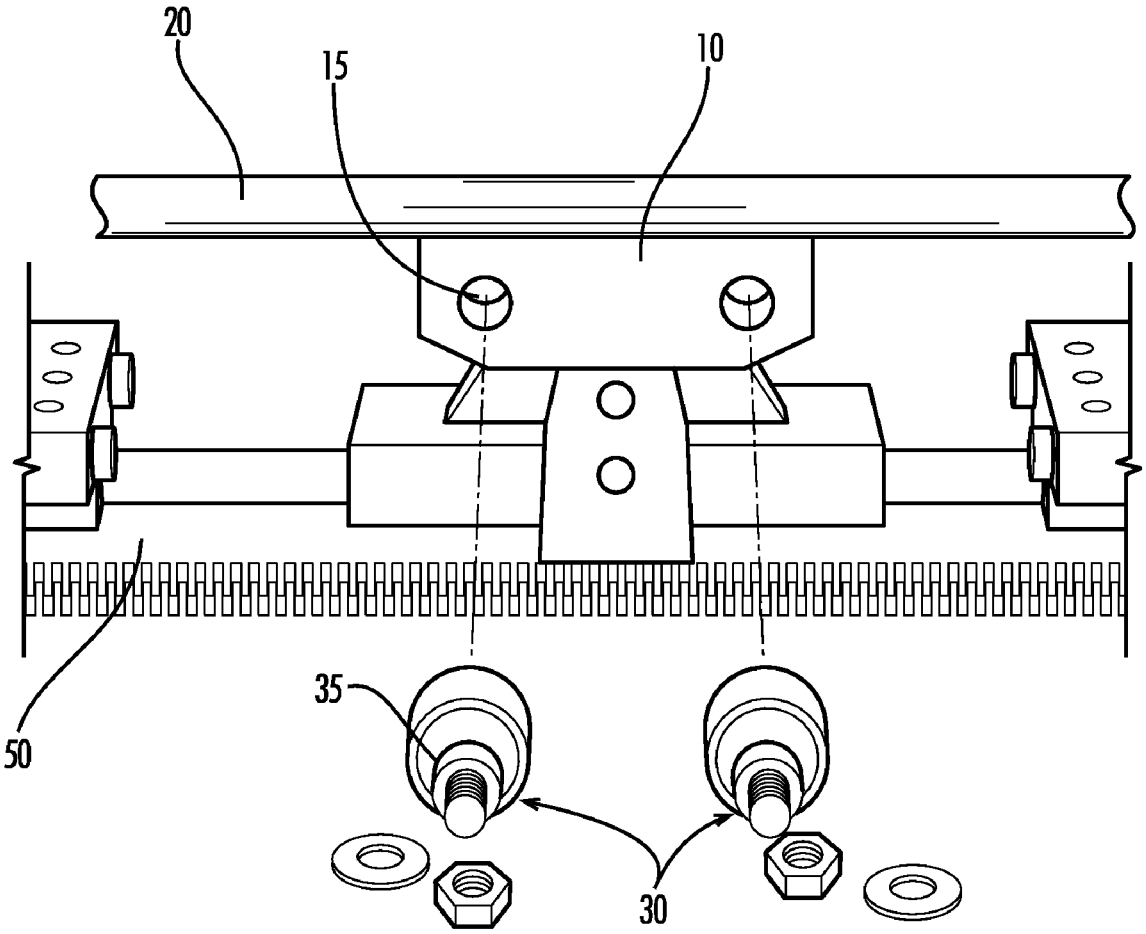
Fig. 2 (Prior Art)
FIG. 2 is a front view of the prior art cam follower of FIG. 1 shown with the bracket's cam follower bearings removed for clarity.
Figure 3:
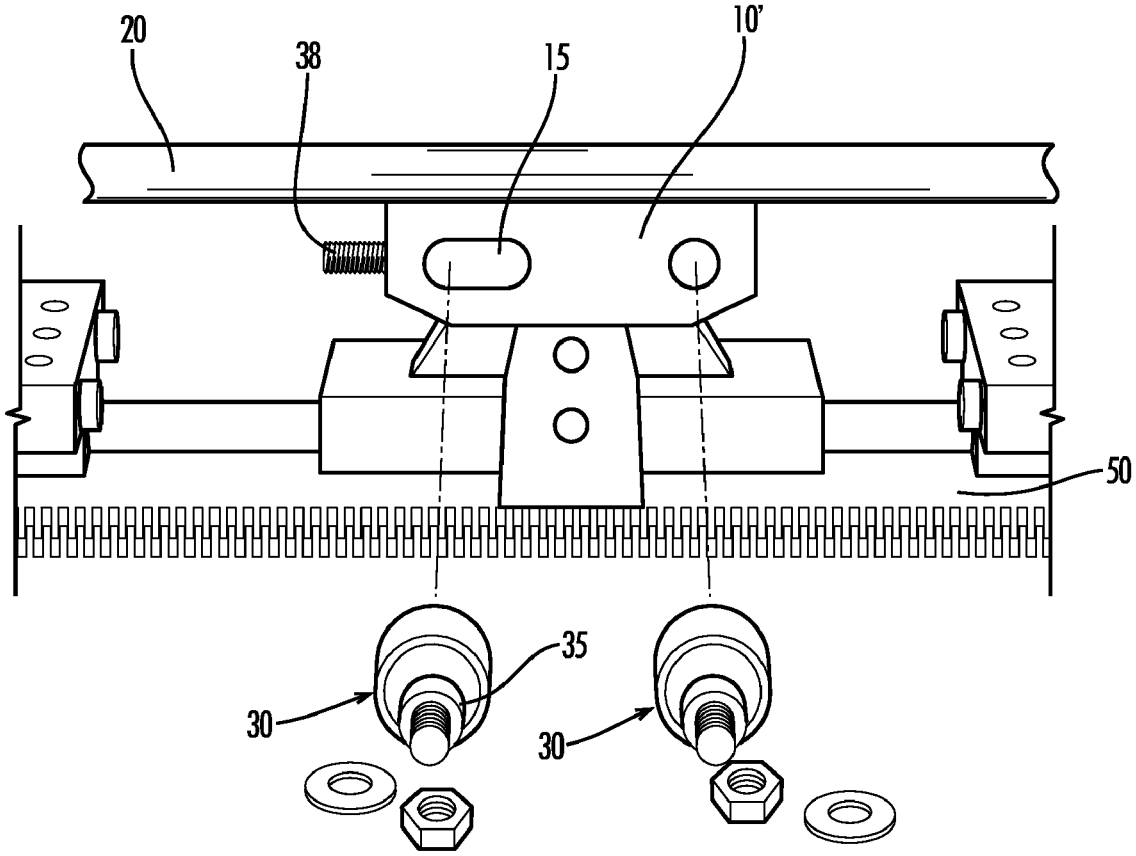
Fig. 3 (Prior Art)
FIG. 3 is a front view of a second prior art cam follower bracket that is mounted onto a tufting machine, shown with the bracket's cam follower bearings removed for clarity.
Figure 4:
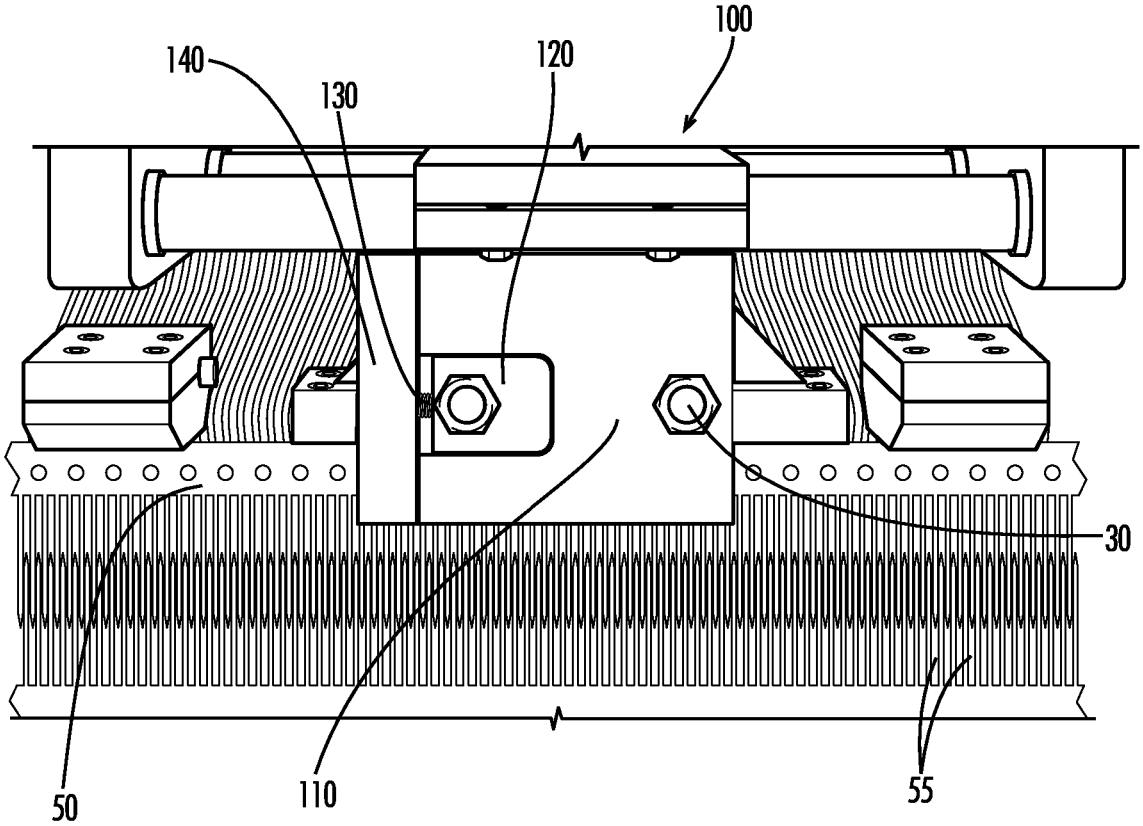
FIG. 4 is a front view of a cam follower bracket according to an example embodiment of the present invention shown mounted onto a tufting machine.
Figure 5:
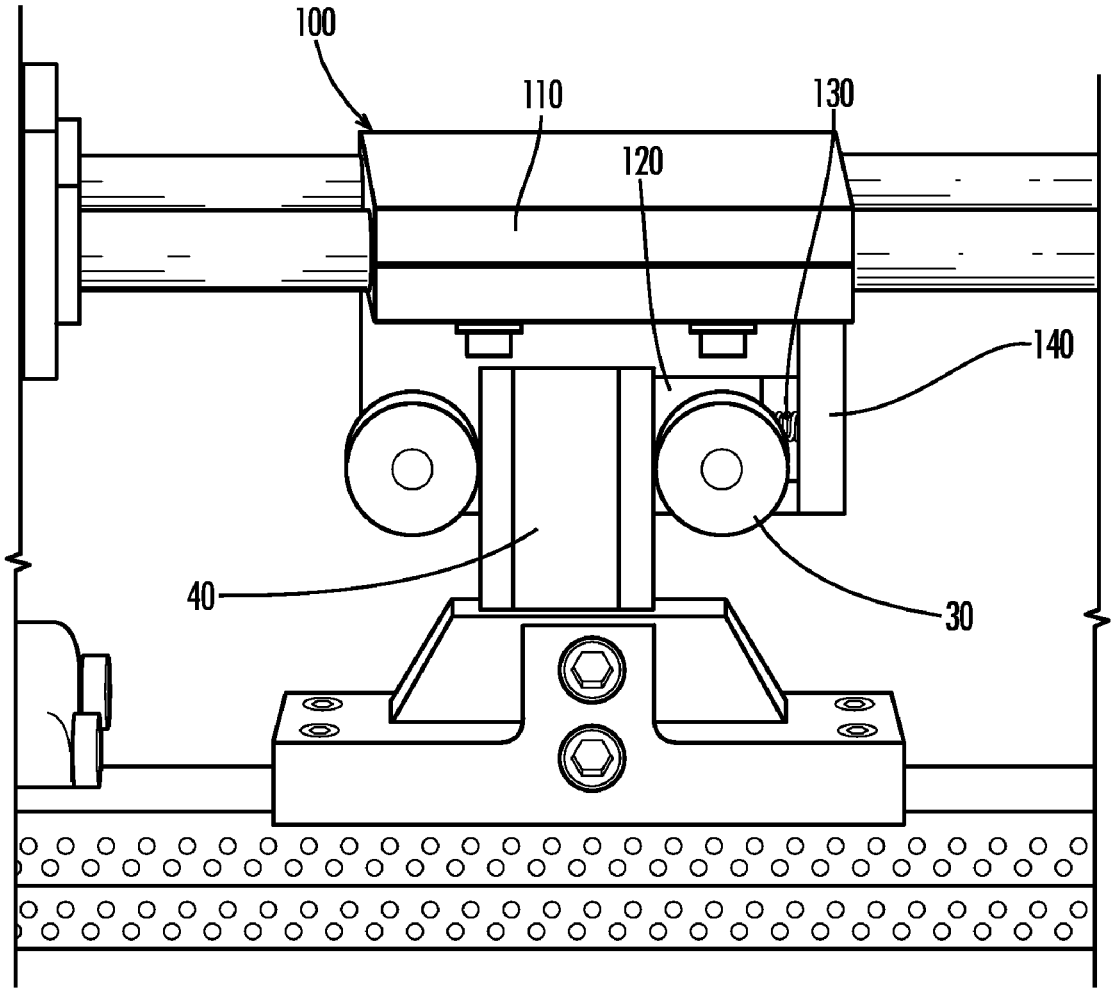
FIG. 5 is a rear view of the cam follower bracket of FIG. 4.

With reference now to the drawing figures, FIGS. 4-8 depict a cam follower bracket 100 according to example embodiments of the present invention. Generally, the bracket 100 comprises a bracket body 110, floating lug 120, compression spring 130, and bracket cap 140, as shown in FIGS. 4-5. The cam follower bracket 100 of the present invention is used in conjunction with textile tufting machines, and often more specifically, with shifting tufting machines used to produce carpet and rugs. The bracket 100 utilizes a floating lug design that self-regulates the amount of pressure that the cam follower bearings 150 apply against the shifter block 40 of the tufting machine (FIG. 5). Because the bracket 100 is able to self-regulate the pressure, the bracket lasts longer and does not need to be periodically monitored and/or tightened. Therefore, less user interaction is required and less machine downtime is needed when operating a tufting machine utilizing a bracket 100 according to the present invention in comparison with known cam follower brackets.

Figure 6:
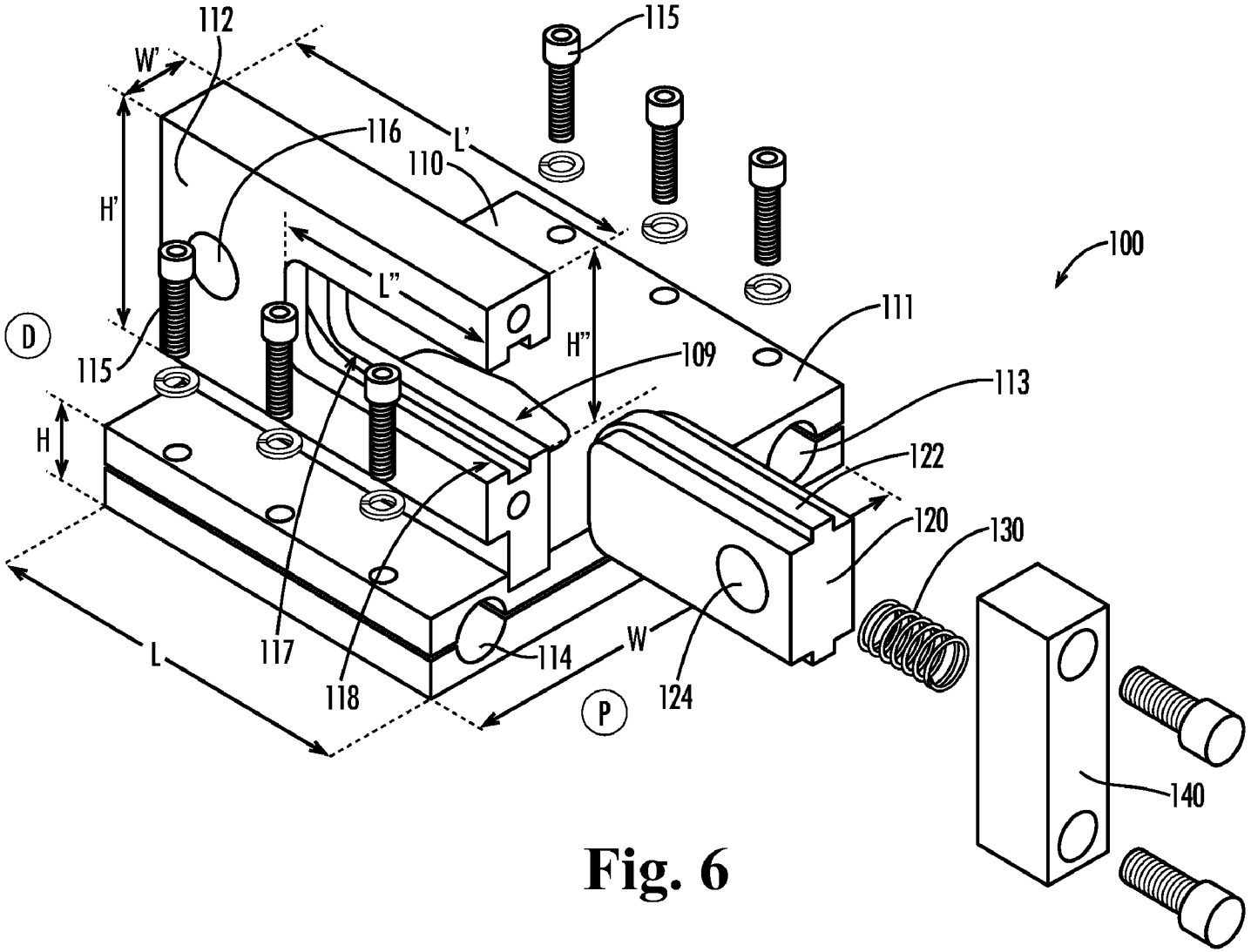
FIG. 6 is an exploded perspective view of a cam follower bracket according to another example embodiment of the present invention.
Figure 7:
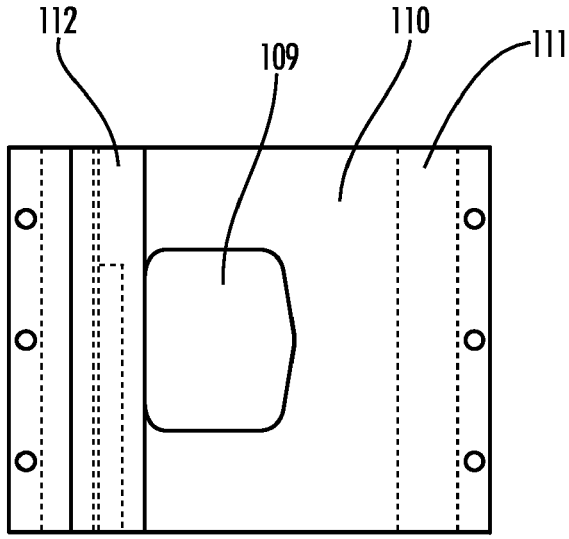
FIG. 7 is a plan view of the cam follower bracket of FIG. 6.
Figure 8:
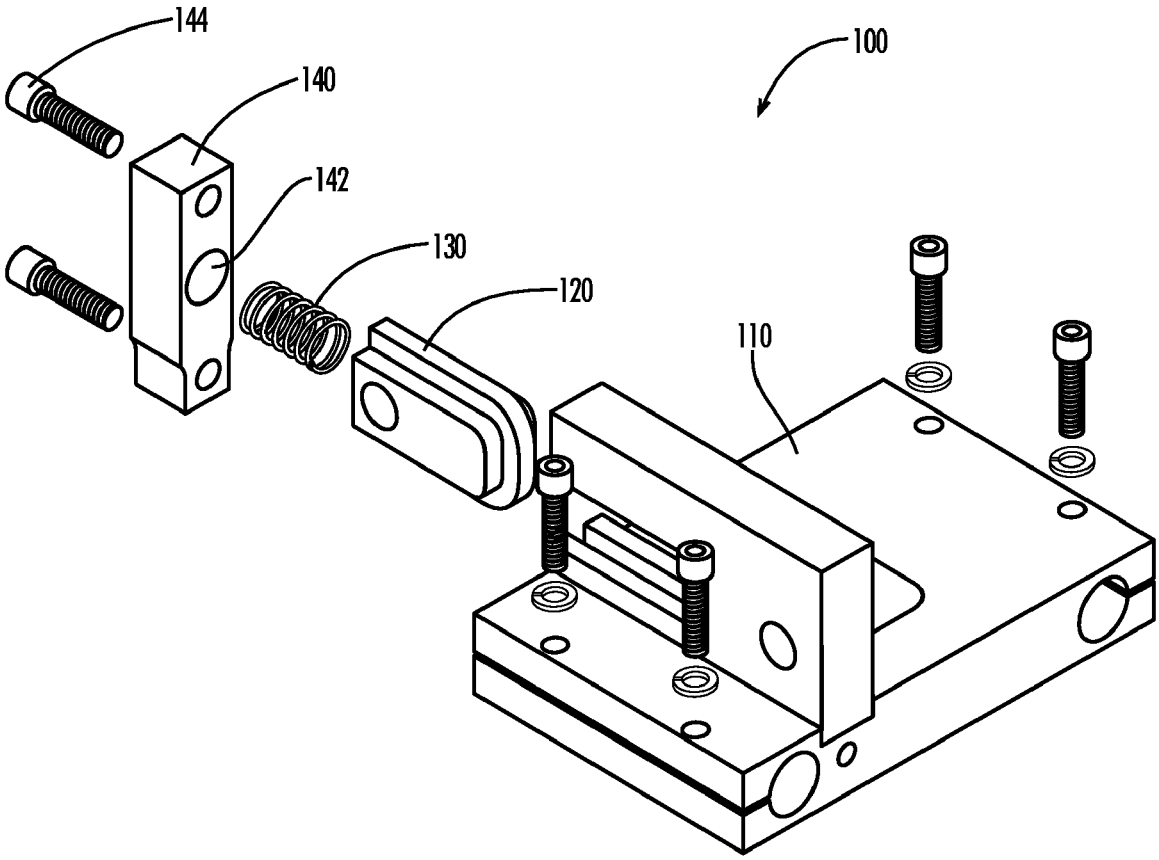
FIG. 8 is an exploded perspective view of a cam follower bracket according to still another example embodiment of the present invention.

In example embodiments of the present invention, the bracket 100 includes a somewhat rigid T-shaped bracket body 110 as depicted in FIGS. 6-7. The body 110 generally comprises a first base section 111 and a second protruding section 112, which is substantially perpendicular in relation to the first to form a shape generally resembling a "T". The two sections can be welded together or can be cast as one piece. In this regard, it is preferred that the body 110 be formed from steel, although in other example embodiments, the body can be formed from other metals, carbon fiber, rigid polymers, or still other materials. The first and second sections 111,112 of the body 110 are respectfully defined by a length L,L', width W,W', and height H,H', as seen in FIG. 6. Additionally, the body 110 can be defined as having a proximal side P and a distal side D. The size of the body 110 can vary dramatically with different example embodiments as needed or desired by a user. Factors such as the length of the needles 55 (see FIG. 4), speed of the machine, and length of the needle bar can influence the size of the body 110 for any given application. Example dimensions will be discussed below.

In example embodiments, the first base section 111 can comprise two cylindrical bores 113, 114 that extend longitudinally through the section's length L as shown in the drawing figures. In other embodiments, one bore, or more than two bores can be used if needed to mount the bracket 100 to a particular machine. Generally, the two bores 113,114 can be used to mount the bracket 100 onto corresponding Thompson bars 20 of a standard tufting machine. Set screws 115, or other similar implements such as machine screws or bolts, can be used to tighten the bores 113,114 against the bars 20. Additionally, the base section 111 can comprise a cutout 109 through the height H of the section, as better seen in FIG. 7, that permits the shifter block 40 to slide therein when the needle bar 50 and block are raised during their reciprocal cycle. The cutout 109 can be any shape as needed to permit clearance for the shifter block 40, however, in example embodiments, the cutout can be rectangular, oval, circular, or a combination thereof.

The second protruding section 112 is generally C-shaped and is a substantially perpendicular protrusion that extends from the base section 111. The second section 112 comprises at least one cylindrical bore 116 through the section's width W', to accommodate a corresponding shaft of a first standard cam follower bearing 30. In preferred example embodiments, only one bore through protruding section 112 is utilized. In other example embodiments, two or more bores may be utilized. Such an arrangement may accommodate shifter blocks 40 that are longer than currently known standard blocks. In example embodiments, the protruding section 112 also comprises a lug cutout 117 through the width W' that extends from the proximal side of the protruding section towards, but not into, bore 116. In preferred embodiments, this cutout 117 is generally rectangular in shape, but in alternate embodiments, the cutout 117 can be oblong, oval, circular, or still other shapes as desired by a user. It can be seen from FIG. 6 that the cutout 117 creates the section's 112 general "C" shape. The lug cutout 117 further comprises a locking channel 118 that extends into the height H' of the second section 112. The channel 118 extends about the perimeter of the cutout 117 and is generally centered about the width W' of the section 112. It is designed to receive a corresponding lip 122 of the floating lug 120 to facilitate a locking interaction between the two. The length L" and height H" of the lug cutout 117 can vary depending on the particular application and overall size of the bracket 100. Example dimensions of the lug cutout 117 will be discussed herein.

In example embodiments of the present invention the floating lug 120 generally corresponds to the dimensions of the lug cutout 117 as best seen in FIGS. 4 & 6. However, typically the length of the floating lug is slightly shorter than the cutout to allow the floating lug 120 the space to slide within the parameters of the cutout, such that the lug has a smooth-sliding fit. As mentioned above, the floating lug 120 includes a lip 122 that corresponds to the locking channel 118 of the lug cutout 117. In example embodiments, the lip 122 is slidably received by the locking channel 118, such that the floating lug 120 is securely accepted therein, but still permitted to slide within the channel and cutout 117 with minimal force. The lip 122 of the floating lug 120 horizontally secures the lug within the bracket body 110, and the lip 122 of the floating lug 120 should be sized to meet the stress and torsional load demands caused by the repetitive sliding of the lug 120 within the cutout 117, in addition to those forces caused by the tufting machine's vibrations. If the lip 122 is not strong enough, it has been found that it can crack and fail. Therefore, in preferred example embodiments, the lip 122 has a width equal to or greater than about ⅓ of the total width of the lug 120. In a typical commercial embodiment, the width of the lip 122 is about ⅓ of the total width of the lug 120. In alternate embodiments, the lip 122 dimensions can be varied to accommodate the needs of a particular application. The floating lug 120 further comprises a cylindrical bore 124 that extends through the width of the lug to accommodate a corresponding shaft of a second standard cam follower bearing 30. Preferably the floating lug 120 is formed from hardened steel, although in other example embodiments, the body can be formed from steel, other metals, carbon fiber, rigid polymers, or still other materials.

Proximally located in regards to the floating lug 120, a compression spring 130 is pressed between the lug 120 and a bracket cap 140 as seen in the drawing figures. In example embodiments, the compression spring 130 can have a load rating of between 70-100 lbs (force required to depress spring to a solid height), although in a typical commercial embodiment a load rating of between 85-90 lbs is most desirable. In alternate embodiments, a load rating exceeding 100 lbs or lower than 70 lbs may be desired depending on the application. The length of the spring 130 can vary, however, example spring lengths can range between 0.5 inches and 2 inches in length. In preferred example embodiments, it has been found that a spring 130 length of approximately 1 inch is desired. Of course, longer or shorter springs 130 can be used. The bracket cap 140, as better seen in FIG. 8, generally corresponds to the height and width dimensions of the protruding section 112 of the bracket body 110. In example embodiments, the length of the cap 140 is generally equal to the width of the cap, although in alternate embodiments, the length of the cap can exceed the width as desired. The cap 140 can also comprise a detent 142 to accommodate the spring's 130 coiled end, which can help stabilize and secure the spring thereto. The bracket cap 140 can be secured to the bracket body 110 with two or more setscrews 144, or other similar means of securing the same, such that the spring is compressed between the floating lug 120 and cap. However, it is preferable that the spring 130 be inserted between the lug 120 and cap 140, such that the spring is not fully compressed. In these embodiments, the spring 130 can be compressed or extended. Preferably, the bracket cap 140 is formed from the same material that the bracket body 110 is formed from.

The bracket 100 is intended for use with known standard cam follower bearings 30 as presently used in the art. In example embodiments, the bearings 30 can be inserted into cylindrical bores 116 and 124, such that the bearing shafts 35 extend through the same. A bolt/nut, as depicted in FIG. 4 can secure the cam follower bearings 30 to the brackets 100. Alternatively, cotter pins, clips, or other type of known fastening relationships can secure the cam follower bearings to the bracket 100. As the tufting machine needle bar 50 reciprocates and vertically displaces the shifter block 40, the bearings 30 follow the contours of the block, which over time begin to wear and often become uneven. The floating lug/compression spring design of the present invention overcomes the drawbacks of known cam follower brackets because the bearings of the present invention do not need to be tightened over the course of their lifespan. As the bearings 30 and shifter block 40 begin to wear, the spring 130 expands and exerts a force on the bearings to keep them pressed against the block without user manipulation. Additionally, when the block 40 and bearings 30 begin to wear unevenly, the spring 130 provides a cushion and permits the lug 120 to move towards and away from the block as needed to maintain a set range of pressure (self-regulatory) at all times during the reciprocal cycle of the needle bar 50. This predetermined acceptable range of pressure extends the life of both the bearings 30 and shifter block 40 and requires much less user supervision. If desired, a user may adjust the pressure applied to the shifter block 40 by interchanging the spring 130 for a spring with a higher or lower load rating. Additionally, it has been found that the present invention reduces the amount of vibration at the needle bar 50, which can prevent damage to the same. Therefore, the present invention is beneficial to the user in that it saves the user time, money, and machine downtime.

As previously mentioned, the dimensions of the various components of the present invention can vary depending on several factors including the length of the needles 55, speed of the machine, length of the needle bar, and desired strength of the bracket 100. While the present invention is certainly not limited to the following example dimensions, the following examples are introduced to display a range of bracket 100 dimensions, as used in typical commercial embodiments. The following dimensions are presented below in inches and are approximated.

| Example | L | W | H | L' | W' | H' | L" | H" |
|---|---|---|---|---|---|---|---|---|
| 1. | 4.75 | 6.00 | 1.00 | 4.75 | .875 | 3.69 | 2.99 | 1.39 |
| 2. | 4.00 | 6.00 | 1.00 | 4.00 | .750 | 2.19 | 2.25 | .875 |
| 3. | 4.00 | 6.00 | 1.00 | 4.00 | .750 | 3.85 | 1.75 | 1.25 |

While the invention has been described with reference to preferred and example embodiments, it will be understood by those skilled in the art that a variety of modifications, additions and deletions are within the scope of the invention, as defined by the following claims.

What is claimed is:

1. A cam follower bracket for use in a carpet tufting machine comprising:

a bracket body for receiving a first cam follower bearing, the bracket body having a first section and a second section substantially perpendicular to the first section, wherein the second section includes a cutout portion;

a biased floating lug for receiving a second cam follower bearing and housed within the cutout portion, the floating lug having a lip; and a bracket cap for securing the biased lug within the bracket body;

wherein said cutout portion includes a channel corresponding to the lip, and wherein the cutout portion slidably receives at least a portion of the biased lug.

2. The cam follower bracket of claim 1, wherein the biased floating lug is biased by a compression spring.

3. The cam follower bracket of claim 2, wherein the spring is compressed between an end of the floating lug and the bracket cap.

4. The cam follower bracket of claim 2, wherein the spring has a load rating of between about 70 and about 100 lbs.

5. The cam follower bracket of claim 2, wherein the spring has a load rating of between about 85 lbs and about 90 lbs.

6. The cam follower bracket of claim 1, wherein the first section of the bracket body is adapted to be mounted to a standard shifting tufting machine's Thompson bars.

7. The cam follower bracket of claim 1, wherein the biased floating lug presses the second cam follower bearing against a shifter block of the tufting machine, and wherein the biased floating lug self-regulates the pressure that the second bearing applies to the shifter block.

8. The cam follower bracket of claim 1, wherein the floating lug is not adjusted by a user over the course of the bracket's lifespan.

9. In a cam follower bracket for use in a shifting tufting machine, the bracket being mounted to the machine's Thompson bars and having a rigid bracket body for receiving therein first and second cam follower bearings to guide and stabilize a shifter block, the improvement comprising:

a floating lug received by a cutout in the bracket that transversely accepts therein the first cam follower bearing;

a bracket cap to secure the floating lug within the cutout in the bracket; and a compression spring secured between the floating lug and bracket cap for biasing the lug, whereby the first cam follower bearing applies a force against the shifter block.

10. The improvement of claim 9, wherein the spring has a load rating of between about 70 lbs to about 100 lbs.

11. The improvement of claim 10, wherein the spring has a load rating of between about 85 lbs to about 90 lbs.

12. The improvement of claim 9, wherein the force applied by the first cam follower bearing onto the shifter block is self-regulated.

13. The improvement of claim 12, wherein the force applied by the first cam follower bearing is variable over the course of one cycle of the shifting tufting machine.

14. The improvement of claim 9, wherein the cutout comprises a channel.

15. The improvement of claim 14, wherein the floating lug comprises a lip that corresponds to the channel for aligning and securing the floating lug within the cutout.

16. The improvement of claim 9, wherein the floating lug is not adjusted over the course of the bracket's lifespan.

* * * * *